United States Patent [19]

Romano

[11] 3,963,917

[45] June 15, 1976

[54] ILLUMINATED SAFETY HELMET

[75] Inventor: James Romano, Staten Island, N.Y.

[73] Assignee: Lawrence Peska Associates, Inc., New York, N.Y. ; a part interest

[22] Filed: Mar. 7, 1975

[21] Appl. No.: 556,107

[52] U.S. Cl. ..... 240/60; 240/6.4 W; 240/10.1; 240/46.55

[51] Int. Cl.[2] ..... A42B 1/24; F21V 7/02

[58] Field of Search..... 240/10.1, 24, 49, 6.4 W, 240/60, 46.55, 46.57, 46.59, 103 R, 46.49 A, 46.49 R; 2/5, 3 R, 6; D2/231

[56] References Cited

UNITED STATES PATENTS

| | | | |
|---|---|---|---|
| 1,514,616 | 11/1924 | Harrison | 240/103 R |
| 2,721,256 | 10/1955 | Duhon | 240/10.1 |
| 2,978,696 | 4/1961 | Keller et al. | 240/59 X |
| 3,056,020 | 9/1962 | Saccomandi | 240/46.49 R X |
| 3,142,833 | 7/1964 | Bosley et al. | 2/5 |
| 3,183,522 | 5/1965 | Groot | 2/6 |
| 3,743,828 | 7/1973 | Fiorenzo et al. | 240/10.1 |

FOREIGN PATENTS OR APPLICATIONS

| | | | |
|---|---|---|---|
| 1,401,264 | 4/1965 | France | 240/60 |

*Primary Examiner*—L. T. Hix
*Assistant Examiner*—Edna Marie O'Connor

[57] ABSTRACT

An illuminated safety helmet is disclosed, which contains a battery powered rotating light source. Rotation of the light source produces a periodic blinking and/or color variation in order to enhance the visibility of the wearer under night time or other poor visibility conditions. The rotating light source is contained in a bubble-like protrusion at the apex of the helmet. A reflective partition separates the light source into two halfs.

4 Claims, 4 Drawing Figures

ILLUMINATED SAFETY HELMET

BACKGROUND OF THE INVENTION

1. Field Of The Invention

The invention is in the field of safety apparel, particularly headgear.

2. Brief Description Of The Prior Art

The desirability of illuminated protective headgear has long been recognized for use by firemen, traffic policemen, emergency utility workers and the like particularly at the scene of accidents or disasters. (See for example U.S. Pats. 1,914,429 issued June 20, 1933; 3,358,137 issued Dec. 12, 1967; 3,749,902 issued July 31, 1973.) Some of these devices have included flashers to turn the light source on and off. However, greater visibility is a continually sought after goal.

SUMMARY OF THE INVENTION

An illuminated safety helmet is disclosed in which visibility is enhanced by a rotating light source which can be arranged to produce periodic color changes as well as to appear to blink on and off. The color combinations can be chosen to match the service colors of the wearer, for purposes of identification, or they can be chosen from among those color combinations which have been shown to be psychologically disconcerting or visually clashing in order to attract attention and further enhance visibility.

The light source and the drive mechanism are mounted so that the emitted light is visible through a transparent, bubblelike protrusion at the apex of the helmet. They are powered by a rechargeable battery, also mounted in the helmet.

DETAILED DESCRIPTION OF THE INVENTION

Figure 1:
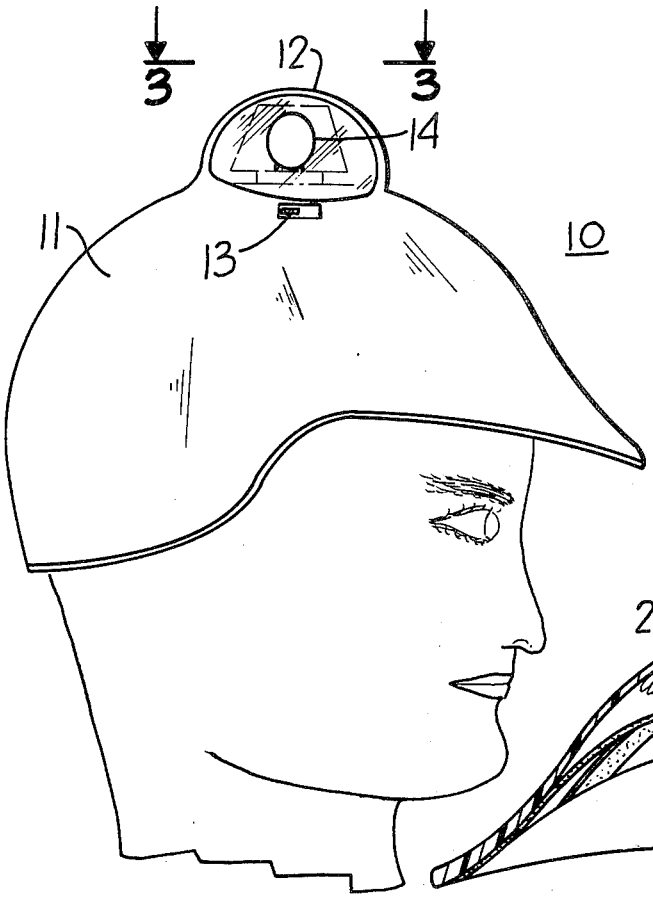
FIG. 1 is an elevational view of an illuminated helmet as viewed from the side aspect of the wearer.

FIG. 1 shows the exterior of a helmet 10 consisting of a hard, tough convex shell 11 with a transparent bubble-like protrusion 12. The shell can be made of any material conventionally used for helmet fabrication. The transparent protrusion should preferably be made of a shatter-resistant material such as plastic in order to withstand the rough treatment commonly found in emergency situations. An on-off switch 13 for the light 14 is conveniently situated next to the protrusion and wired into the light and rotational drive circuit or circuits. The protrusion 12 is preferably at the apex of the shell 11, but in any event is situated such that it is visible for 360° around the wearer.

Figure 2:
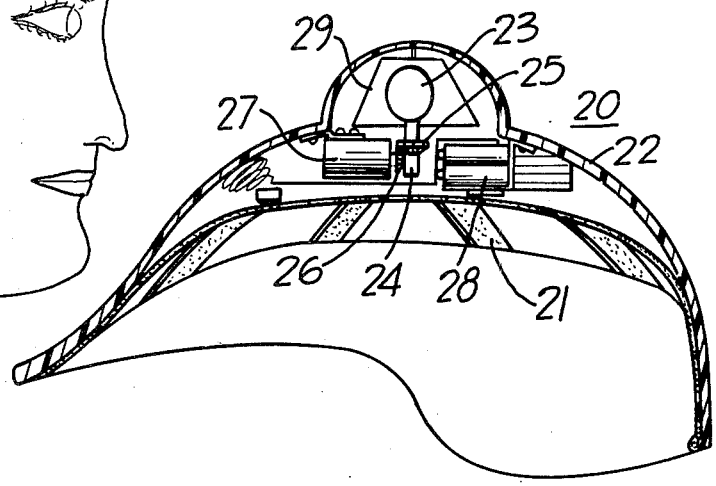
FIG. 2 is an elevational view in section of a helmet of FIG. 1.

In FIG. 2 the helmet 20 is sectioned to show the adjustable harness 21 which keeps the head of the wearer from contacting the inner surface of the shell 22 or any other of the equipment mounted in the helmet 20. The light source 23 (here an incandescent bulb) is rotatably mounted on a shaft 24 equipped with a bevel gear 25. This gear engages another bevel gear 26 mounted on a drive shaft on the drive motor 27, so that when the switch 13 is in the "on" position, current from the rechargeable battery 28 energizes the source and causes it to rotate. An opaque partition 29 is rotatably mounted together with the light source 23 in order to visually separate the two halves of the bulb 23. The halves of the bulb 23 can be colored differently or one half can be darkened. Additional partitions can be employed to achieve other periodic sequences of color change and/or darkening. A mirror-like surface finish on the partition 29 enhances the visual effect of the rotating light source 23.

Figure 3:
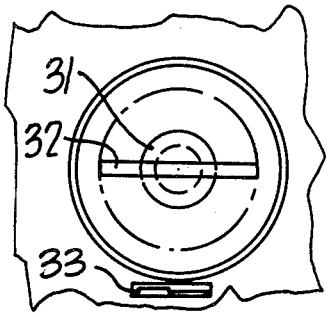
FIG. 3 is a top view of the transparent bubble region of a helmet of FIG. 1.

FIG. 3 shows the top view of the bubble portion of the helmet 10 with the light source 31, the intersecting partition 32 and the on-off switch 33.

Figure 4:
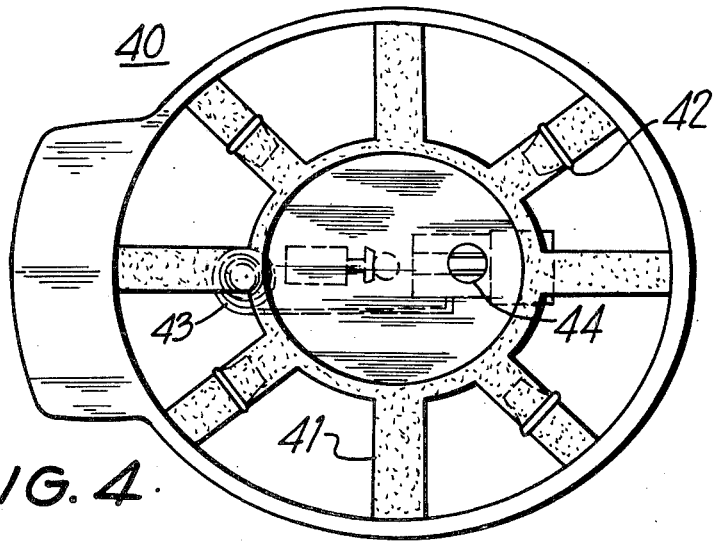
FIG. 4 is a bottom view of a helmet of FIG. 1.

In FIG. 4 the bottom view of the helmet 40 shows the harness 41 with adjustable straps 42, a battery charging receptacle 43 and a battery insertion orifice 44.

What is claimed is:

1. An illuminated safety helmet comprising:

a. a hard, tough convex shell adapted for serving as a protective cover for the head of the wearer, which shell possesses a transparent bubble-like protrusion at its apex, which protrusion is adapted for visibility from any unobstructed lateral aspect;

b. an adjustable harness affixed to the inner periphery of the helmet to keep the head of the wearer from contacting the inner surface of the shell;

c. an incandescent bulb rotatably mounted in the transparent protrusion, upon which incandescent bulb is fixed a vertically oriented mirror-like partition visually separating the bulb into differently colored halves, said bulb adapted to be coupled to a source of energy;

d. driving means for rotating the bulb, adapted to be coupled to said source of energy;

e. a switch electrically connected to be capable of interrupting the source of energy and mounted on the shell and conveniently reachable by the wearer.

2. A helmet of claim 1 in which the partition is mirror-like on both sides.

3. A helmet of claim 1 in which the driving means comprises an electric motor including a drive shaft, including a first bevel gear connected to the drive shaft, and in which the bulb is connected to a second bevel gear which engages the first bevel gear.

4. A helmet of claim 1 including means for recharging the source of energy.

* * * * *